US010343398B2

(12) United States Patent
Nielsen et al.

(10) Patent No.: US 10,343,398 B2
(45) Date of Patent: Jul. 9, 2019

(54) SYSTEM AND METHOD FOR CREATING A PICO-FLUIDIC INKJET

(71) Applicant: HEWLETT-PACKARD DEVELOPMENT COMPANY, L.P., Houston, TX (US)

(72) Inventors: Jeffrey A. Nielsen, Corvallis, OR (US); Craig Olbrich, Corvallis, OR (US); Richard W. Seaver, Corvallis, OR (US); David R. Otis, Jr., Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/896,292

(22) Filed: Feb. 14, 2018

(65) Prior Publication Data

US 2018/0186150 A1 Jul. 5, 2018

Related U.S. Application Data

(63) Continuation of application No. 11/505,258, filed on Aug. 15, 2006, now Pat. No. 9,944,074.

(51) Int. Cl.
*B41J 2/14* (2006.01)
*B41J 2/16* (2006.01)

(52) U.S. Cl.
CPC ..... *B41J 2/1404* (2013.01); *B41J 2/14* (2013.01); *B41J 2/14201* (2013.01); *B41J 2/16* (2013.01); *B41J 2/1603* (2013.01); *B41J 2/1607* (2013.01); *B41J 2/1626* (2013.01); *B41J 2/1631* (2013.01); *B41J 2/1639* (2013.01); *B41J 2/1645* (2013.01); *B41J 2202/11* (2013.01)

(58) Field of Classification Search
CPC ..... B41J 2/1404; B41J 2/1639; B41J 2/1607; B41J 2/14201; B41J 2/14; B41J 2/1631; B41J 2/1645; B41J 2/16; B41J 2/1626; B41J 2/1603; B41J 2202/11
See application file for complete search history.

(56) References Cited

U.S. PATENT DOCUMENTS

| | | | |
|---|---|---|---|
| 4,730,197 A | 3/1988 | Raman et al. | |
| 4,835,435 A | 5/1989 | Yeung | |
| 5,218,376 A | 6/1993 | Asai | |
| 5,596,416 A | 1/1997 | Barry | |

(Continued)

FOREIGN PATENT DOCUMENTS

| | | | |
|---|---|---|---|
| EP | 0936070 | * 8/1999 | ..... B41J 2/14 |
| EP | 1366906 | 12/2003 | |
| WO | WO-0137960 | 5/2001 | |

OTHER PUBLICATIONS

Reichmuth, D.S., Et Al; "On-Chip High-Pressure Picolitre Injector for Pressure-Driven Flow Through Porous Media"; Analytical Chemistry, Journal, Sep. 1, 2004; 5063-5068; vol. 76; No. 17 (Abstract Only).

*Primary Examiner* — Henok D Legesse
(74) *Attorney, Agent, or Firm* — Fabian VanCott

(57) ABSTRACT

An inkjet material dispenser system includes a printhead member. According to one exemplary embodiment, the printhead member includes at least one drop ejector including an insulating stack layer and a top orifice surface defining an orifice, wherein a ratio of a diameter of the orifice to a height of the insulating stack layer (O/L ratio) is at least 1.0.

20 Claims, 4 Drawing Sheets

(56) References Cited

U.S. PATENT DOCUMENTS

| | | | | |
|---|---|---|---|---|
| 5,754,202 | A | 5/1998 | Sekiya et al. | |
| 6,149,815 | A | 11/2000 | Sauter | |
| 6,161,924 | A | 12/2000 | Mitani et al. | |
| 6,382,771 | B1 | 5/2002 | Ikeda | |
| 6,467,882 | B2 | 10/2002 | Inui et al. | |
| 6,488,364 | B1 | 12/2002 | Nakajima et al. | |
| 6,951,622 | B2 | 10/2005 | Chung | |
| 7,055,723 | B2 | 6/2006 | Ingenhoven et al. | |
| 7,070,262 | B2 | 7/2006 | Yamamoto et al. | |
| 9,944,074 | B2 * | 4/2018 | Nielsen | B41J 2/14 |
| 2002/0008737 | A1 * | 1/2002 | Inui | B41J 2/1404 347/56 |
| 2002/0135650 | A1 | 9/2002 | Nagai et al. | |
| 2008/0273045 | A1 | 11/2008 | Morohoshi et al. | |

* cited by examiner

SYSTEM AND METHOD FOR CREATING A PICO-FLUIDIC INKJET

BACKGROUND

Micro-pipettes have traditionally been used for depositing fluid onto well-plates but they generally have a much higher drop volume than is typically desired. Since low drop volumes are desirable, operators using micro-pipettes use a "touch off" technique that is very operator dependent, thereby increasing the likelihood of cross-contamination.

Recently there has been an interest in using jetted technologies for the precision dispensing of high-value materials. Some specific examples of these applications include the printing of reagents, enzymes or other proteins into well-plates for the purpose of fluid mixing or initiating chemical reactions. Prior solutions have included continuous inkjet (CIJ) technology, which offers relatively high velocities and drop volumes. Unfortunately CIJ systems are relatively more expensive than other systems because not all printer head components are wafer-fab compatible and because of complicated ink recirculation systems. Additionally, due to the extra recirculation systems and other various components, the distance between the CIJ and the substrate is much larger than is preferred. Other technologies such as Thermal Inkjet (TIJ) and Piezo Inkjet (PIJ) drop-on-demand printheads have traditionally been limited to the jetting of colorant in imaging and marking applications. Recently there has been an interest in using TIJ and PIJ technologies in the above applications, but success has been limited. This limited success is because TIJ and PIJ technologies have mainly been designed for high quality imaging applications, not dispensing of high-value materials.

SUMMARY

According to one exemplary embodiment, a printhead member includes at least one drop ejector including a stack layer which consists of a chamber layer and an orifice layer, wherein the orifice layer defines an orifice. According to this exemplary embodiment, a ratio of a diameter of the orifice to a height of the stack layer (O/L ratio) is at least 1.0.

According to another exemplary embodiment, an inkjet material dispenser system includes a reservoir member, and a printhead member, wherein the printhead member includes at least one drop ejector including a stack layer which consists of a chamber layer and an orifice layer, wherein the orifice layer defines an orifice. According to this exemplary embodiment, a ratio of a diameter of the orifice to a height of the stack layer (O/L ratio) is at least 1.0.

BRIEF DESCRIPTION OF THE DRAWINGS

The accompanying drawings illustrate various embodiments of the present system and method and are a part of the specification. The illustrated embodiments are merely examples of the present system and method and do not limit the scope thereof.

DETAILED DESCRIPTION

The present exemplary systems and methods provide for the creation and operation of a printing system to deliver fluids in research and development processes. In particular, according to one exemplary embodiment, a pico-fluidic inkjet is described herein that can be manufactured with a drop ejector able to dispense, but in no way limited to, difficult-to-eject, high-valued fluids at high velocities. According to one exemplary embodiment, the present pico-fluidic inkjet has a reservoir, a chamber, a chamber layer, an actuating member, an actuator layer, an insulating stack layer, an orifice layer and an orifice. Further details of the present pico-fluidic inkjet, as well as exemplary methods for using the inkjet to dispense fluids onto a desired substrate will be described in further detail below.

As used in the present specification, and in the appended claims, the term "pico-fluidic inkjet" is meant to be understood broadly as including any material dispensing apparatus that may be used for the deposition of ink and other fluids including, but in no way limited to, drop-on-demand, thermal, piezoelectric, or hybrid dye-sublimation inkjets, and the like.

In the following description, for purposes of explanation, numerous specific details are set forth in order to provide a thorough understanding of the present systems and methods for forming a pico-fluidic inkjet system. It will be apparent, however, to one skilled in the art that the present systems and methods may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Many references will be made to numbered items in various figures. References to a common number used in different figures, may or may not necessarily be referring to the same component. The context of the reference part will be understood from the included writing.

Figure 1:
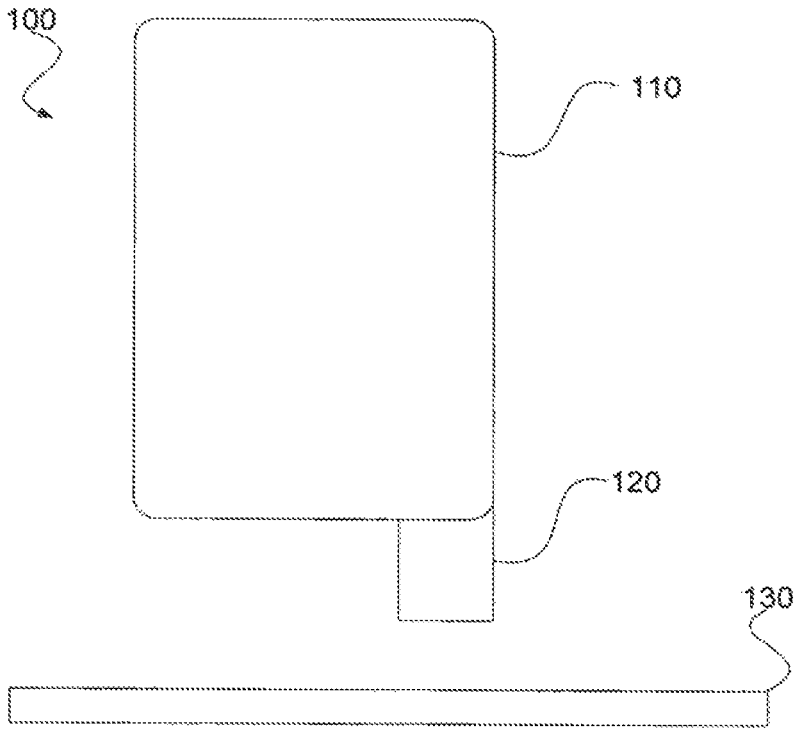
FIG. 1 illustrates an embodiment of basic jetted ink dispensing system, according to one exemplary embodiment.

FIG. 1 illustrates an exemplary pico-fluidic inkjet system (100), according to one exemplary embodiment. As shown, the inkjet system (100) includes a material reservoir (110) and a dispenser (120). According to one exemplary embodiment, the system (100) is used to dispense or deposit a desired material onto the substrate (130). In addition to storing fluids, aqueous or otherwise, the exemplary material reservoir (110) illustrated in FIG. 1 may also contain solids in other various forms such as a powder. The dispenser (120) may also be produced in many forms, as will be discussed in greater detail below. The substrate (130) can include, but is no way limited to, a printable surface such as paper, plastic, ceramic, fabric, semiconductive material, a Petri dish, a well plate, or the like. An exemplary method and system of using the inkjet system (100) to print on various surfaces will also be discussed in greater detail below.

For the purposes of the present detailed description and the appended claims, the term "drop ejector" is meant to be understood as including a chamber, a chamber layer, an actuator layer, an actuating member, an insulating stack, a orifice layer and an orifice. The components of a drop ejector need not be exactly the same in each drop ejector, e.g., when talking of two separate drop ejectors the chamber dimensions may vary in each.

Additionally, for the purposes of the present detailed description and the appended claims, the term "stack layer height" is meant to be understood as a sum of the thicknesses of the chamber layer and the orifice layer of any given drop ejector. The term "stack layer" refers the chamber and orifice layers deposited above the actuating member.

Figure 2:
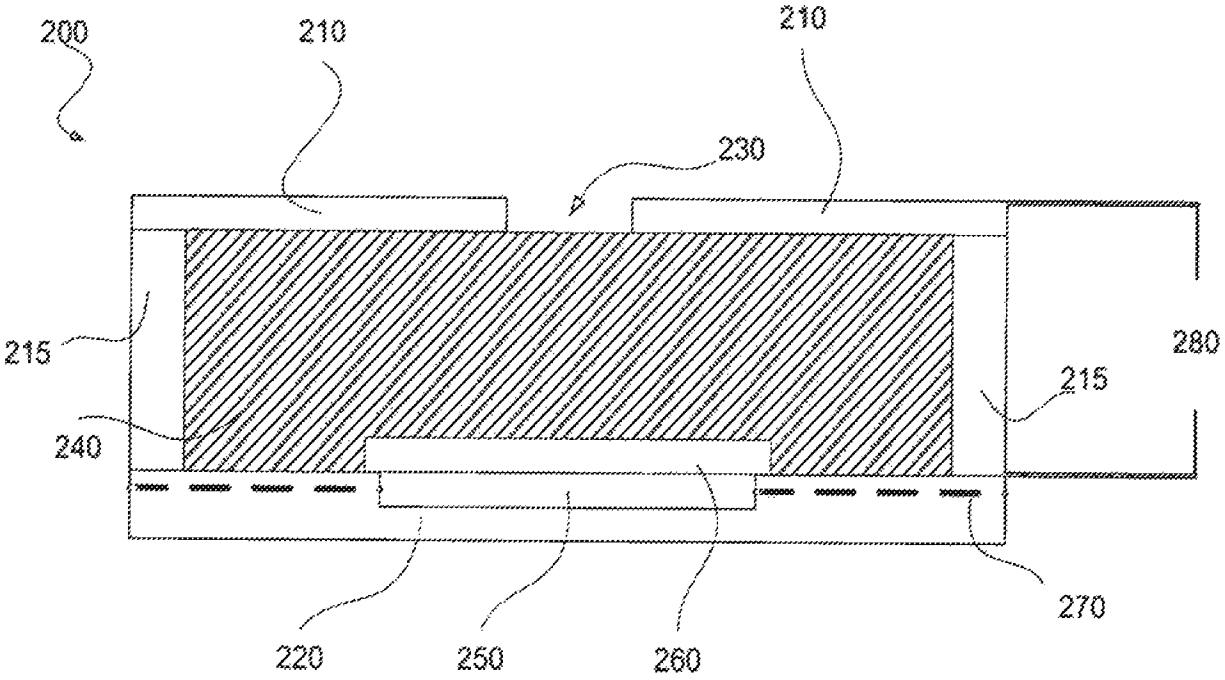
FIG. 2 illustrates a side view of an inkjet drop ejector.

FIG. 2 illustrates a side view of an exemplary drop ejector (200). The exemplary drop ejector found in FIG. 2 demonstrates a top ejecting (or bottom ejecting depending on orientation) dispenser. Although a top ejecting dispenser will be discussed in the present detailed description, the present exemplary system and method may utilize a side dispenser or a dispenser oriented at a certain angle, e.g., forty-five degree dispenser. As illustrated in FIG. 2, the drop ejector (200) is defined by an orifice layer (210), an actuator layer (220), and a chamber layer (215). The orifice (210) and actuator (220) layers, as well as the chamber layer (215) can be fabricated from, but are in no way limited to the following materials: glasses, plastics, semiconductors, and/or metals. The sum of the thicknesses of the orifice (210) and chamber (215) layers is noted as the stack layer height (280). An orifice member (230) is defined in and by the orifice layer (210). As illustrated, the orifice member (230) is an orifice of predetermined dimensions which directly influence performance metrics such as, but not limited to, ejection efficiency, decap time, exit velocity, tail length, drop weight, etc. FIG. 2 also illustrates a material to be dispensed (240) from the orifice member (230) disposed within the drop ejector (200). Further, there is an actuating member (250), covered by an insulating stack material (260). The exemplary actuating member (250) may be, but is not limited to, a thermal resistor, a piezoelectric filament, or any mechanical means by which the ejection of the material (240) may be accomplished. The actuating member (250) is activated in response to an electrical signal that is applied via an electrode (270). For example, according to one exemplary embodiment, the drop ejector (200) may be configured to dispense a material (240) such as an aqueous ink solution. Using a thermal resistor as the actuating member (250), a signal can then be applied via the electrode (270). This action causes a small portion of the solution to vaporize, creating an expanding bubble which ejects a drop of material through the orifice (230). Upon ejection, the drop ejector (200) will refill with a material (240) from the material reservoir (not shown).

Note that the drop ejector (200) represented in FIG. 2 is isolated and appears as a unique structure. However, any number of drop ejector (200) structures may be fabricated on a single printhead.

Traditional uses for a fluidic inkjet material dispenser include printing, labeling, imaging and the like. Each of these activities demands a certain amount of precision to minimize variations in aspects such as grain size, drop size, tail length, and dot shape to name a few. According to one exemplary embodiment, the present systems and methods may not have the same limitations when applied to non-imaging procedures. As used herein, non-imaging procedures can include, but are no way limited to the following, printing of reagents, enzymes or other proteins into well-plates, Petri dishes, or filters for the purpose of fluid mixing or initiating chemical reactions.

Figure 3:
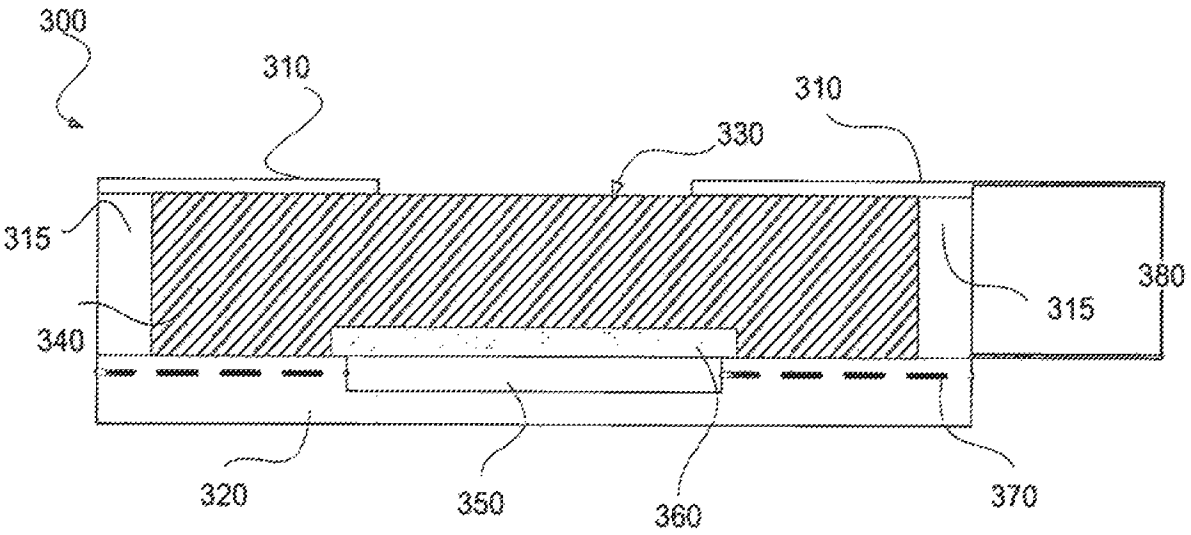
FIG. 3 illustrates a side view of a non-traditional inkjet drop ejector using the present system, according to one exemplary embodiment.

The present exemplary system has the same basic form and components as those referred to and discussed with reference to FIG. 2, with a few notable exceptions. Referring now to FIG. 3, a side view of the present exemplary system is shown. As illustrated in FIG. 3, the drop ejector (300) is defined by an orifice layer (310), an actuator layer (320), and a chamber layer (315), similar to those described previously in FIG. 2. Once again the sum of the thicknesses of the orifice (310) and chamber (315) layers is noted as the stack layer height (380). According to the illustrated embodiment, the orifice (310) and actuator (320) layers, as well as the chamber layer (315) can be fabricated using, but are in no way limited to the following materials: glasses, plastics, semiconductors, and/or metals. Additionally, an orifice member (330) is defined in and by the orifice layer (310). According to the present exemplary embodiment, the orifice member (330) is an orifice of predetermined dimensions which directly influence performance metrics such as, but not limited to, ejection efficiency, decap time, exit velocity, tail length, drop weight, etc. FIG. 3 also illustrates the material to be dispensed (340) disposed within the drop ejector (300).

Furthermore, FIG. 3 illustrates an actuating member (350), covered by an insulating stack material (360). As previously mentioned, the actuating member (350) may be, but is in no way limited to, a thermal resistor, a piezoelectric filament, or any mechanical means by which the ejection of material (340) may be accomplished. According to one exemplary embodiment, the actuating member (350) is activated in response to an electrical signal that is applied via the electrode (370). For example, according to one exemplary embodiment, the drop ejector (300) may be configured to dispense a material (340) including a solution containing high-valued enzymes. Using a thermal resistor as the actuating member (350), a signal can then be applied via the electrode (370). The application of a signal to the electrode (370) causes a small portion of the solution to vaporize, creating an expanding bubble which ejects a drop through the orifice (330).

According to one exemplary embodiment, the present systems and methods differ from a traditional inkjet delivery system by including a printhead drop ejector that is not practical for a traditional imaging inkjet system. Specifically the present exemplary systems and methods use a combination of at least one or more of the following attributes, higher orifice diameter to stack layer height ratios (O/L ratio), higher resistor length to orifice diameter ratios (R/O ratio), larger actuating members (350), and thinner stack layers (380). Each of the previous attributes modifies the drop ejector (300) in such a way that a combination of at least one or more of the following benefits is obtained: high throw drops, higher ejection efficiency, improved decap performance, and improved coefficient of variation, i.e., the ratio of the standard deviation to the mean, herein referred to as CV. Further details of the above-mentioned attributes as well as the attribute modifications will be provided below.

Using a combination of the following attributes: higher O/L ratio, higher R/O ratio, larger actuating member (350), and thinner stack layer (380), an increased drop volume and velocity can be obtained. By having higher drop volume and velocity, higher momentum can be achieved which in turn leads to high throw, a characteristic that while not well suited to forming inkjet images is often desired for dispensing difficult-to-eject, high-valued fluids at high velocities onto a desired substrate. The present exemplary system illustrated in FIG. 3 can be applied in various formats. In one exemplary embodiment the present system can be applied to a designable material dispenser (DMD). DMDs include any number of disposable printheads designed and fabricated to perform a desired task. In one exemplary embodiment a DMD may be configured with orifice characteristics that allow a researcher to choose the printhead that accommodates the characteristics of a particular fluid. Orifice characteristics can be designed to accommodate, but are not limited to, the following parameters: density, viscosity, boiling point, and size of the particles in solution (e.g., metal particles, proteins, DNA, biological cells). The adaptable characteristics of a DMD-like orifice diameter stack layer height, and actuating member size allow for customization for various applications and market opportunities. Further, DMDs are relatively low in cost.

The formation of a printhead uses many technologies associated with semiconductor processing and integrated circuit design. According to one exemplary embodiment, a printhead can be integrally manufactured using a photolithography process. A substrate of a predetermined thickness is typically prepared as the actuator layer of the drop ejector (300). Vias and circuitry are then created on the surface of the wafer using photolithographic and metal deposition processes. The vias and circuitry are connected to an actuating member, which is formed on the substrate. An insulating stack layer is then grown or deposited on the surface of the actuating member to provided protection from the chemical contents to be dispensed and possible cavitations. A chamber layer is created using a negative photoresist. A sacrificial layer is then deposited on the surface of the wafer, upon which the orifice layer of the drop ejector is formed. Using a positive photoresist and an etchant, a orifice can be formed into the orifice layer of the drop ejector. The sacrificial layer is then removed via an etchant or acid bath. A method for fabricating printheads with the present exemplary configuration will now be described below.

Figure 4:
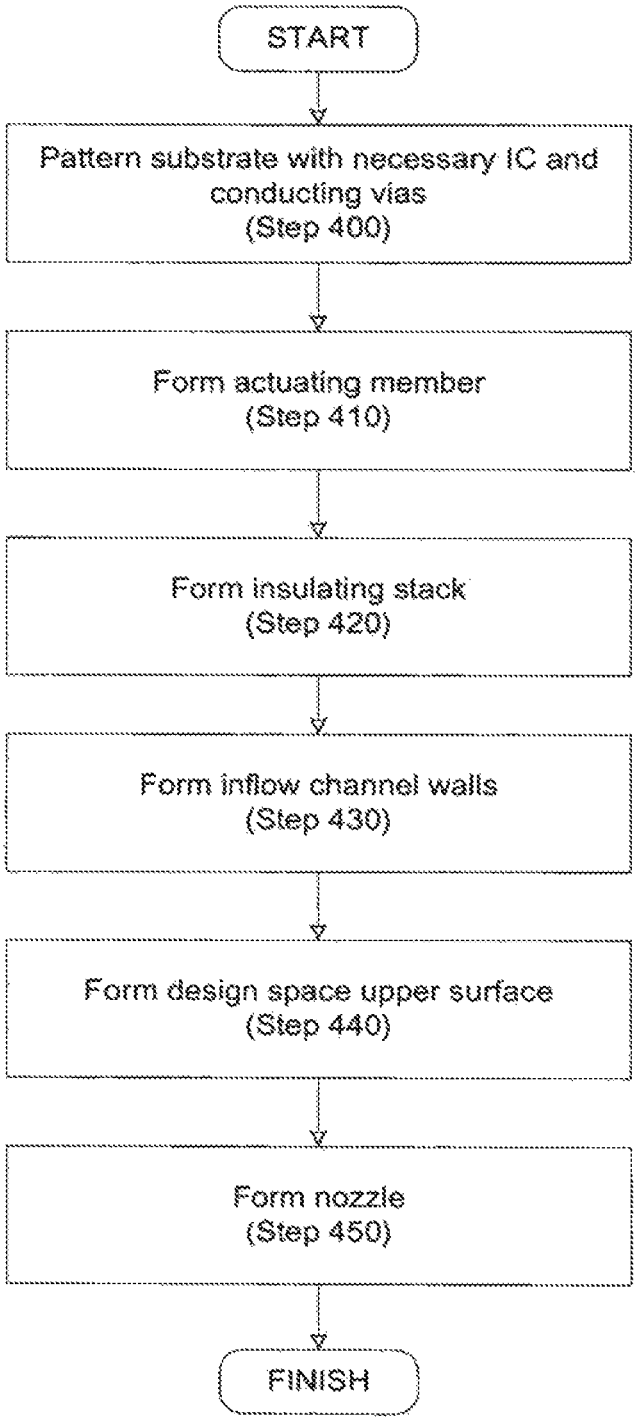
FIG. 4 is a flow chart of an exemplary method for forming an inkjet material dispenser, according to one exemplary embodiment.

According to one exemplary embodiment, a thermal driving type inkjet printhead having the structure described in reference to FIG. 3 above can also be manufactured using a photolithography process. Referring now to FIG. 4, a substrate of a predetermined thickness is patterned with a conductive material for conducting vias and integrated circuitry (400). An actuating member is then prepared and formed on the surface of the substrate using photolithography or other similar methodologies. In accordance with the present exemplary system, the actuating member is of a length and width configured to facilitate R/O ratio, and ejection velocity as described above. The actuating member is connected to the IC through the conducting vias (410).

Once the actuating member is formed, an insulating stack layer is formed over the actuating member to protect the actuating member (420). The formation of the insulating stack layer over the actuating member could be done in many ways including, but not limited to, spinning on an insulating layer, and patterning it to sufficiently cover said actuating member. According to the present exemplary system and method, the insulating stack is formed to be sufficiently thin to meet the predetermined criteria of the present system.

After the forming of the actuating member and insulating stack, a negative photoresist is coated on the entire surface of the substrate to a predetermined thickness. Coated photoresist is then pattered using a photolithography process so as to surround the material chamber and create the chamber layer (430). With the patterned photoresist forming the chamber layer (430), a sacrificial layer is then formed by filling the space that is surrounded by the chamber layer with a positive photoresist. Over this sacrificial layer a negative photoresist is then deposited and patterned creating the orifice layer of the drop ejector (440). Specifically, the sum of the thicknesses of the chamber and orifice layer is sufficiently thin to achieve higher O/L ratios and higher velocities with lower drop weights with higher efficiencies, as compared to traditional TIJ material dispensers.

Using a last photolithography process, a orifice is formed in the orifice layer of the drop ejector (450). As previously mentioned, the orifice is formed with dimensions configured to generate high O/L, and R/O ratios, high throw design, and improved decap times, as described above. The sacrificial layer is also removed opening up the chamber of the drop ejector.

EXAMPLES

A number of DMDs were formed using the methodologies illustrated in FIG. 4 and having dimensions similar to those described in connection with FIG. 3. The operating characteristics of the DMDs formed according to the present system and method were then compared to traditional TIJ material dispensers. The results are detailed in Tables 1 through 5 below.

Table 1 below illustrates a comparison of the kinetic energy of three traditional thermal inkjets and three DMDs incorporating the present system and method.

TABLE 1

| | | Drop Mass [ng] | Drop Mass kg | Drop Velocity [m/s] | Momentum [kgm/s] | Energy of Drop [J] | Energy of Drop [nJ] | Energy Inputted [nJ] | Efficiency unit less |
|---|---|---|---|---|---|---|---|---|---|
| Traditional | 1 | 5 | 5.0E−12 | 12.0 | 6.00E−11 | 3.60E−10 | 0.36 | 961 | 0.0375% |
| TIJ | 2 | 35 | 3.5E−11 | 12.0 | 4.20E−10 | 2.52E−09 | 2.52 | 5000 | 0.0504% |
| | 3 | 220 | 2.2E−10 | 12.0 | 2.64E−09 | 1.58E−08 | 15.84 | 24000 | 0.0660% |
| Non- | 1 | 270 | 2.7E−10 | 16.3 | 4.40E−09 | 3.59E−08 | 35.87 | 30000 | 0.1196% |
| Traditional | 2 | 145 | 1.5E−10 | 17.0 | 2.47E−09 | 2.10E−08 | 20.95 | 15000 | 0.1397% |
| TIJ | 3 | 75 | 7.5E−11 | 19.9 | 1.49E−09 | 1.49E−08 | 14.85 | 10000 | 0.1485% |

As shown in Table 1 above, the drops of material ejected by high throw designs 1 through 3 have more energy than all but the largest drops used in traditional imaging inkjets. While high velocity drops can be generated by incorporating larger actuating members (350), high R/O ratio by itself generally creates more waste heat. Rather, the present exemplary drop ejector (300) illustrated in FIG. 3 incorporates a thinner stack layer (380) above the actuating member, when compared to traditional drop ejectors (200; FIG. 2), resulting in higher velocities achieved with lower drop weights and higher efficiencies. Additionally, the modified drop ejector (300) produces material drops having longer tails and modified drop shape, characteristics that can be sacrificed when depositing material such as difficult-to-eject, high-valued fluids at high velocities into well-plates and other desired substrates. As used in Table 1, the measure of efficiency equals the ratio of the energy of the ejected drop over the energy inputted into the actuating member (350), i.e., output to input ratio. As shown in Table 1, there is a marked increase in efficiency of the DMDs using the present system over the printheads using a traditional drop ejector. More particularly, the traditional printheads have efficiencies ranging from 0.035-0.07%, while the DMDs using the present system are above 0.1% efficient.

Table 2 below illustrates a number of exemplary dimensions of the tested material dispensers as well as their respective orifice diameter to stack layer height ratios (O/L) and R/O ratios.

TABLE 2

| | | Drop Weight | Resistor L um | Orifice Diameter um | Chamber um | Orifice um | Total Stack L um | R/O unit less | O/L unit less | R/OL [100*1/um] |
|---|---|---|---|---|---|---|---|---|---|---|
| Traditional | 1 | 5 | 18 | 14.6 | 14 | 14 | 28 | 1.23 | 0.52 | 44.03 |
| TIJ | 2 | 35 | 35 | 28 | 25 | 50 | 75 | 1.25 | 0.37 | 16.67 |
| | 3 | 220 | 102 | 59 | 41 | 50 | 91 | 1.73 | 0.65 | 19.00 |
| Non- | 1 | 270 | 120 | 75 | 22 | 40 | 62 | 1.60 | 1.21 | 25.81 |
| Traditional | 2 | 145 | 85 | 60 | 22 | 20 | 42 | 1.42 | 1.43 | 33.73 |
| TIJ | 3 | 75 | 65 | 43 | 22 | 20 | 42 | 1.51 | 1.02 | 35.99 |

As can be seen in Table 2, the O/L ratios of the DMDs using the present system range from 1.00-1.45, which is significantly larger than the O/L ratio of traditional TIJ material dispensers, which range from 0.35-0.65. Table 2 also illustrates that the R/O ratios of the DMDs using the present exemplary configuration illustrated in FIG. 3 are larger than all but the largest volume traditional TIJ material dispensers. Additionally, DMDs using the present exemplary configuration exhibit an R/O ratio range of between approximately 1.45-1.6+ in contrast to traditional TIJ material dispensers which have an R/O ratio of approximately 1.25, the exception again being the largest volume traditional TIJ. As described above these enhancements to the drop ejector (300) allow the present system to have a high throw velocity.

Table 3 shows the throw distance of ejected drops, where the distance traveled is defined to be the location relative to the orifice where the velocity has decreased to 1% of the initial value. While current imaging printheads use approximately 5 pL volumes and 12 m/s velocity, and consequently have a travel distance of about 11 mm, the DMDs using the present exemplary system have drop volumes in the 100-250 pL range and velocities in the 15-20 m/s range, and consequently have travel distances between 70 and 120 mm.

TABLE 3

| | Distance Traveled (mm) | | | | |
|---|---|---|---|---|---|
| Initial Velocity (m/s) | 5 pL | 100 pL | 150 pL | 200 pL | 250 pL |
| 10 | 9.7 | | | | |
| 11 | 10.5 | | | | |
| 12 | 11.2 | | | | |
| 13 | 11.9 | | | | |
| 14 | 12.6 | | | | |
| 15 | 13.3 | 73.4 | 91.6 | 107.1 | 120.9 |
| 16 | 13.9 | 76.5 | 95.4 | 111.5 | 125.8 |
| 17 | 14.6 | 79.5 | 99.1 | 115.8 | 130.5 |
| 18 | 15.2 | 82.5 | 102.7 | 119.9 | 135.1 |
| 19 | 15.9 | 85.3 | 106.2 | 123.9 | 139.5 |
| 20 | 16.5 | 88.1 | 109.5 | 127.7 | 143.8 |
| 21 | | 90.8 | 112.8 | 131.5 | 148.0 |
| 22 | | 93.4 | 116.0 | 135.1 | 152.0 |
| 23 | | 96.0 | 119.1 | 138.7 | 156.0 |

TABLE 3-continued

| | Distance Traveled (mm) | | | | |
|---|---|---|---|---|---|
| Initial Velocity (m/s) | 5 pL | 100 pL | 150 pL | 200 pL | 250 pL |
| 24 | | 98.5 | 122.1 | 142.1 | 159.8 |
| 25 | | 100.9 | 125.0 | 145.5 | 163.5 |

Generally higher velocities mean higher throw drops. High throw drops are especially advantageous when applied to non-imaging procedures such as enzyme implantation or chemical mixing. For example, a DMD as detailed in Tables 1 and 2 can be used to dispense an enzyme into a well-plate. The high throw of the dispenser is not only inexpensive in comparison to CIJ material dispensers, but also uses less fluid than a CIJ or an operator using a micro-pipette. Further, where as traditional TIJ material dispensers are limited by the distance that they can eject a drop, the DMDs having a volume of about 100 pL and a initial velocity of 19.9 m/s can travel 88 mm before velocity is reduced to 1% of initial velocity. Having the extra latitude in firing distance, allows the DMDs to jet onto non-flat topography, such as indentations in coating applications or well-plates, where the interference between the material dispensers itself and the topography prevents moving the orifices close to the substrate of interest. Particularly, in well-plate applications such as the current example, high throw minimizes the amount of fluid that sticks to the side walls of a well and maximizes the amount of the fluid that reaches the bottom of the well. Thus, high throw improves the efficiency of the jetting event and allows effective mixing and deposition onto the surface of interest.

As mentioned previously, a DMD incorporating the present exemplary system and method also exhibits improved decap performance and CVs. As used herein, decap is meant to be understood as the length of time that a fluid remains a liquid while being exposed to the atmosphere in the orifice. Short decap times are due to increasingly small orifices and rapidly evaporating solutions Due to the nature of the fluids used by the present exemplary system, decap time is a very relevant consideration. Many functional materials (sol gels, pre-cursors, nano-particle suspensions, monomers, to name a few) are diluted or based in highly-evaporative solvents. Consequently, decap performance when jetting functional materials is much worse than typically seen with the aqueous colorant fluids dispensed by traditional inkjet material dispensers. The present system overcomes such obstacles by incorporating higher O/L and R/O ratios, larger actuating members (350), and thinner stack layers (380). A DMD drop ejector exhibiting the above mentioned attributes is particularly suited for the selective deposition of a number of functional materials. A DMD drop ejector using the present system (300) evacuates a higher percentage of the total volume available (thereby improving CVs) and improves drop velocity, which translates to improved decap times.

Further, Table 4 illustrates the corresponding volumes of the orifice, chamber and their sum to determine the ejection efficiency (total volume ejected vs. volume available in chamber and orifice) of the inkjet material dispenser.

TABLE 4

| | | Orifice Volume [um^3] | Chamber Volume [um^3] | Total Volume [um^3] | Total Volume [pl] | Ejection Efficiency [%] |
|---|---|---|---|---|---|---|
| Traditional | 1 | 2678 | 9464 | 12142 | 12 | 41.2% |
| TIJ | 2 | 45844 | 46225 | 92069 | 92 | 38.0% |
| | 3 | 163686 | 460676 | 624362 | 624 | 35.2% |
| Non- | 1 | 181377 | 338272 | 519649 | 520 | 52.0% |
| Traditional | 2 | 58425 | 174262 | 232687 | 233 | 62.3% |
| TIJ | 3 | 30400 | 104742 | 135142 | 135 | 55.5% |

As can be seen in Table 4, the ejection efficiency of traditional TIJ material dispensers ranges from approximately 35-42%. In contrast, the DMDs incorporating the present system and method exhibit an increased ejection efficiency of between 50 and 63%.

Moreover, Table 5 illustrates an overall comparison of traditional TIJ material dispensers to DMDs that incorporate the present exemplary system and method. More specifically, Table 5 includes a comparison between the ratios of nucleation pressure to viscous loss (ReXEu, Re being the Reynolds number and Eu being Euler's number).

TABLE 5

| | | Drop Wt. | Resistor L um | Orifice Dia. um | Orifice Rad. um | Cham. um | Orifice um | Total Stack L um | R/O unit less | O/L unit less | ReXEu unit less |
|---|---|---|---|---|---|---|---|---|---|---|---|
| Traditional | 1 | 5 | 18 | 14.6 | 7.3 | 14 | 14 | 28 | 1.23 | 0.52 | 31.86 |
| TIJ | 2 | 35 | 35 | 28 | 14 | 25 | 50 | 75 | 1.25 | 0.37 | 22.99 |
| | 3 | 220 | 102 | 59 | 29.5 | 41 | 50 | 91 | 1.73 | 0.648352 | 59.42 |
| Non- | 1 | 270 | 120 | 75 | 37.5 | 22 | 40 | 62 | 1.60 | 1.21 | 185.56 |
| Traditional | 2 | 145 | 85 | 60 | 30 | 22 | 20 | 42 | 1.42 | 1.43 | 208.92 |
| TIJ | 3 | 75 | 65 | 43 | 21.5 | 22 | 20 | 42 | 1.51 | 1.02 | 106.55 |

As can be seen in Table 5, the traditional TIJ material dispensers exhibit a ReXEu ratio that ranges from 30-60. In contrast, the ReXEu ratios exhibited by the DMDs using the present exemplary system and method range from 100-200. As previously mentioned, the DMDs incorporating the present exemplary system and method have a higher O/L and R/O ratio, larger actuating members (350), and a thinner stack layer (380). These attributes also resulted in improved decap times when compared to traditional TIJ material dispensers.

The improved decap times exhibited by the present DMDs result in many advantages including, but in no way limited to, eliminating printing defects associated with startup/decap, crisp startup edges, high printhead utilization, the ability to use traditionally difficult-to-eject fluids, and improved directionality via closer media spacing.

In conclusion, the present exemplary system and method provide a simple printhead with a modified drop ejector that is inexpensive, versatile and designed for non-imaging processes. More specifically, according to one exemplary embodiment, the present drop ejector includes a chamber, a chamber layer, an orifice layer, an orifice, an actuator layer, an actuating member, and insulating stack configured to achieve high throw drops, higher O/L and R/O ratios, higher ejection efficiency, improved decap performance, and improved C.Vs.

The preceding description has been presented only to illustrate and describe the present system and method. It is not intended to be exhaustive or to limit the disclosure to any precise form disclosed. Many modifications and variations are possible in light of the above teaching. It is intended that the scope of the disclosure be defined by the following claims.

What is claimed is:

1. A system for depositing materials, the system comprising:

a droplet ejector comprising:

a chamber layer having a thickness (CT) of no less than 20 micrometers, the chamber layer comprising a chamber, and an orifice layer comprising an orifice providing an outlet from the chamber, the orifice layer covering the chamber layer, wherein a ratio of the orifice diameter (D) to chamber layer thickness (CT) is from 43:22 to 75:22.

2. The system of claim 1, further comprising a well plate positioned to receive the ejected droplets.

3. The system of claim 1, wherein the orifice diameter (D) is from 43 micrometers to 75 micrometers.

4. The system of claim 1, further comprising a supply, the supply providing liquid to the droplet ejector for ejection, wherein the supply comprises a non-aqueous solvent, the non-aqueous solvent having a volatility greater than water.

5. The system of claim 1, further comprising a supply, the supply providing liquid to the droplet ejector for ejection, wherein the supply comprises a sol-gel.

6. The system of claim 1, further comprising a supply, the supply providing liquid to the droplet ejector for ejection, wherein the supply comprises an enzyme.

7. The system of claim 1, further comprising a supply, the supply providing liquid to the droplet ejector for ejection, wherein the supply comprises solid particles in the liquid.

8. The system of claim 1, wherein a droplet ejected by the droplet ejector has a volume from 20 picoliters to 250 picoliters.

9. The system of claim 1, wherein a droplet ejected by the droplet ejector has a volume no less than 52% of a volume of the chamber.

10. The system of claim 1, wherein the droplet ejector further comprises a heater, wherein when the system provides an electrical firing signal to the heater, the droplet ejector ejects a droplet and a ratio of kinetic energy of an ejected droplet to an amount of electrical energy provided to the heater in the firing signal is at least 11:10000.

11. A system for depositing materials, the system comprising:

a droplet ejector comprising:

a reservoir to contain a liquid to be ejected by the droplet ejector, the liquid comprising a non-aqueous solvent, the non-aqueous solvent having a volatility greater than water;

a chamber layer comprising a chamber, the chamber to receive liquid from the reservoir;

an orifice layer comprising an orifice, the orifice providing an outlet from the chamber and the orifice layer covering the chamber layer, wherein the orifice has a diameter (D) and the chamber layer has a thickness (CT), and a ratio of the orifice diameter (D) to the chamber layer thickness (CT) is from 43:22 to 75:22.

12. The system of claim 11, wherein the liquid further comprises a sol-gel.

13. The system of claim 11, wherein the droplet ejector further comprises a heater, wherein when the system provides an electrical firing signal to the heater, the droplet ejector ejects a droplet and a ratio of kinetic energy of an ejected droplet to an amount of electrical energy provided to the heater in the firing signal is at least 11:10000.

14. The system of claim 11, wherein the orifice diameter (D) is from 43 micrometers to 75 micrometers.

15. A system for depositing materials, the system comprising:

a droplet ejector comprising:

a chamber layer having a thickness (CT) of no less than 20 micrometers;

an orifice layer covering the chamber layer, the orifice layer having a thickness (OT) and comprising an orifice providing an outlet from a chamber in the chamber layer, the orifice having a diameter (D);

a heater having a length (L) exposed to the chamber, wherein the droplet ejector ejects a droplet in response to the heater receiving an electrical firing pulse from the system, the ejected droplet has a ratio of kinetic energy to an amount of electrical energy provided to the heater in the firing pulse of at least 11:10000, a ratio of D to OT is from 75:40 to 60:20, a ratio of D to CT is from 43:22 to 75:22, and the ejected droplet volume is from 20 picoliters to 250 picoliters.

16. The system of claim 15, wherein the droplet comprises a non-aqueous solvent, the non-aqueous solvent having volatility greater than water.

17. The system of claim 15, wherein the droplet ejector has a ratio of L to OT from 3:1 to 4:1.

18. The system of claim 15, further comprising a petri dish to receive the ejected droplet.

19. The system of claim 15, wherein a volume ratio of the ejected droplet volume to a chamber volume, where the chamber volume does not include a nozzle volume, is from 0.52:1 to 0.62:1.

20. The system of claim 15, wherein the ejected droplet volume is from 100 picoliters to 250 picoliters.

* * * * *